United States Patent [19]

Csaszar

[11] Patent Number: 4,479,586

[45] Date of Patent: Oct. 30, 1984

[54] TAMPER-EVIDENT CONTAINER WITH DROP DOWN SKIRT

[75] Inventor: Ernest J. Csaszar, Mountainside, N.J.

[73] Assignee: General Kap Corporation, Bound Brook, N.J.

[21] Appl. No.: 526,488

[22] Filed: Aug. 25, 1983

Related U.S. Application Data

[63] Continuation-in-part of Ser. No. 383,705, Jun. 1, 1982, , which is a continuation-in-part of Ser. No. 142,429, Apr. 21, 1980, Pat. No. 4,343,408.

[51] Int. Cl.[3] ..... B65D 49/12

[52] U.S. Cl. ..... 215/258; 215/252

[58] Field of Search ..... 215/252, 253, 258

[56] References Cited

U.S. PATENT DOCUMENTS 4,343,408 8/1982 Csaszar ..... 215/258

4,417,666 11/1983 Roberts ..... 215/258

*Primary Examiner*—George T. Hall

*Attorney, Agent, or Firm*—Lerner, David, Littenberg Krumholz & Mentlik

[57] ABSTRACT

Tamper-evident containers are disclosed, including a container having a neck portion and an annular collar portion located below the neck portion, and a closure for application to the container including a one-piece closure body having a horizontal end wall and a cylindrical side wall including an upper portion, a depending lower skirt portion, and an intermediate side wall portion therebetween. The depending lower skirt portion includes an inwardly projecting bead having an internal diameter which is no greater than the outer diameter of the container at a predetermined location directly below the annular collar portion, so as to provide an interference fit therebetween at that predetermined location when the closure is completely applied to the container. The intermediate side wall portion includes an area of weakness which is designed to fracture when the closure is removed from the container, so as to leave the depending lower skirt portion on the container after the upper portion has been removed, and the container includes an inwardly directed non-locking tapered surface at that predetermined location, whereby after fracture of the closure at the area of weakness the depending lower skirt portion is caused to move downwardly along the non-locking tapered surface and away from the annular collar portion to provide visual evidence of fracture.

15 Claims, 10 Drawing Figures

TAMPER-EVIDENT CONTAINER WITH DROP DOWN SKIRT

CROSS-REFERENCE TO RELATED APPLICATIONS

This application is a continuation-in-part of U.S. patent application Ser. No. 383,705, filed on June 1, 1982, which in turn is a continuation-in-part of U.S. patent application Ser. No. 142,429, which was filed on Apr. 21, 1980, now U.S. Pat. No. 4,343,408.

FIELD OF THE INVENTION

The present invention is directed to tamper-evident containers. More specifically, the present invention is directed to such containers which include closures having a frangible portion which is designed to fracture when the closure is removed from the container, thereby evidencing the fact that the container has been opened. Still more particularly, the present invention is directed to such containers including means for insuring that the portion of the closure which remains on the container after the closure has been removed is designed to separate from the upper portion of the container so as to visibly reveal fracture thereof.

BACKGROUND OF THE INVENTION

Applicant has previously disclosed and patented a commercially significant improvement upon those prior plastic and metal closures for bottles and containers which are designed to include a tamper-evident feature. In most cases, this tamper-evident feature had comprised a lower shoulder or skirt portion of the closure, which was in some way intended to fracture or break upon removal of the closure from the container, so that it then became evident that the container had been opened. A large number of these closures had been known in the past, even on a commercial basis, and particularly in connection with soda bottles and other such containers maintained under significant pressures. Up until quite recently, metal closures had predominated in this respect. However, applicant's prior invention which was set forth in U.S. patent application Ser. No. 142,429, now U.S. Pat. No. 4,343,408, has now been quite successful in replacing these prior closures.

In that regard, applicant's patented closure has significantly improved upon these prior closures, particularly in that applicant's device has now permitted the closure to be removed cleanly and efficiently, and to obtain the fracture of the lower skirt portion in a highly reliable manner. Furthermore, applicant has provided a commercial closure which can be applied in a single step to the container or bottle, and which can at the same time result in efficient breaking or fracturing upon closure removal.

In the past, it has also been desired to produce such a tamper-evident closure in which the skirt portion of the closure, which is intended to remain on the container after removal of the closure itself, is somehow caused to drop down on the bottle, so that even after the upper portion of the closure is returned to the bottle or container, it remains visibly clear that fracture has previously occurred. That is, in the large majority of these prior closures this has not been possible, and even where efficient fractures were obtained the skirt portion, which remained on the container, substantially maintained its original location vis-a-vis the annular collar portion of the container, so that upon reapplication of the top portion of the closure the top portion of the closure and the skirt portion were sufficiently close together that upon casual visual observation it was not always apparent that fracture had occurred. When this occurred, the entire purpose underlying the use of these closures would then have been defeated.

For example, in U.S. Pat. No. 3,224,616 to Fields, the desirability of this drop down feature is discussed. In that case, the closure includes a metallic skirt 23, which depends from the side wall 13 of the cap 2. In this manner, upon removal of the cap skirt 23 is intended to drop downwardly until its shoulder 27 abuts bead 29, so that the skirt envelopes bead 29 on the bottle as shown. This patentee also provides for coloring the upper surface of the shoulder 27 so that it can be visually observed upon removal.

Another such closure as disclosed in U.S. Pat. No. 4,147,268 to Patel et al, as is the desirability of such a drop down feature is again discussed. In this case, the closure includes both an annular flange 24 and a lower skirt portion 22 depending therefrom, and after breaking off from the closure locking member 28 is left around the neck 12 of the closure, as shown in FIG. 4 thereof.

Additionally, U.S. Pat. No. 3,622,028 to Lohrer also discusses the desirability of such a drop down feature. In this case, the patentee employs a push-off tab 10 facilitating removal of the upper portion of the cap 4 from the lower apron 11 by tearing along tear strip 12. Once this tearing operation has been completed, the patentee states that the interior bulging portion 12*a* is therefore no longer urged upwardly against protuberance 3 and apron 11, which fits loosely around the container, will drop downwardly.

Other closures of this general type are shown in U.S. Pat. Nos. 3,944,102 to Grau; 3,968,942 to Herrmann; and 4,299,328 to Ochs et al.

It has therefore been recognized as being very desirable to fine a closure of this type which cannot only be easily applied, but whose fracture is assured with ease and without the inadvertent removal of the skirt portion, as is the case in the aforesaid U.S. Pat. No. 4,343,408, but which is also devised in a way which insures that, subsequent to fracture, the remaining skirt portion drops downwardly from its original location directly below the collar portion of the container so as to provide clear visible evidence of fracture in all cases.

SUMMARY OF THE INVENTION

These and other objects have now been accomplished by the discovery of a tamper-evident container which includes a container having a neck portion and an annular collar portion below that neck portion, and a closure for application to the container in which the closure comprises a one-piece closure body including a horizontal end wall and a cylindrical side wall. The cylindrical side wall includes an upper portion, a depending lower skirt portion, and an intermediate side wall portion therebetween, with the depending lower skirt portion including an inwardly projecting bead which has an internal diameter no greater than the outer diameter of the container at a predetermined location directly below the annular collar portion, so as to provide an interference fit therebetween. The intermediate side wall portion of the closure includes a frangible portion comprising an area of weakness designed to fracture when the closure is removed from the container, so as to leave the depending lower skirt portion on the container after the upper portion has been removed therefrom, the container including an inwardly directed non-locking tapered surface at the predetermined location below the annular collar portion thereof, whereby after fracture of the closure the depending lower skirt portion is caused to move downwardly along the non-locking tapered surface of the container, and away from the annular collar portion so as to provide visual evidence of fracture.

In accordance with a preferred embodiment of the tamper-evident container of the present invention, the internal diameter of the inwardly projecting bead is less than the outer diameter of the container at the predetermined location. This not only assists in providing a firm interference type fit between the inwardly projecting bead and the container at the predetermined location immediately below the collar portion thereof, but helps assist in moving the remaining skirt portion downwardly subsequent to fracture. In particular, a spring type action results and the skirt portion, after fracture, is thus physically urged downwardly along the nonlocking tapered surface of the container.

In accordance with another embodiment of the tamper-evident container of the present invention, the frangible portion divides the intermediate side wall portion into an upper intermediate side wall portion and a lower intermediate side wall portion above and below the fringible portion, respectively. The frangible portion preferably comprises bridge means located circumferentially around the closure, with the bridges being sufficiently thin and flexible so as to be capable of collapsing when the inwardly projecting bead passes over the annular collar portion of the container as the closure is being applied to the container, to thereby permit the upper and lower intermediate side wall portions to abut against each other and thereby permit the closure to be applied to the container without fracturing the bridges.

In accordance with a preferred embodiment of the tamper-evident container of the present invention, the neck portion of the container is a threaded neck portion, and the upper portion of the cylindrical side walls of the closure comprise an internally threaded upper portion. Preferably, the upper and lower intermediate side wall portions of the closure are in substantial alignment with each other in the plane of the cylindrical side wall.

In accordance with a preferred embodiment of the tamper-evident closure of the present invention, the non-locking tapered surface of the container comprises an angle of more than about 8°, and preferably between about 10° and 20°, most preferably between about 14 and 16; such as about 15°.

In accordance with another embodiment of the tamper-evident container of the present invention, at least a portion of the upper and lower intermediate side wall portions include juxtaposed parallel surfaces in the horizontal plane dividing the closure for providing surfaces for abutment of the upper and lower intermediate side wall portions upon collapse of the bridge means. Preferably, the lower intermediate side wall portion includes a plurality of stabilizer members, and the upper intermediate side wall portion includes a protruding cam member for engagement with the plurality of stabilizer members, i.e., the portions of the lower intermediate side wall portion which include the parallel surfaces, so as to insure that the depending lower skirt portion is caused to move downwardly when the closure is re-applied to the container subsequent to fracture.

In accordance with another embodiment of the tamper-evident container of the present invention, the bridge means comprise a plurality of bridges located circumferentially around the closure, and preferably including eight bridges located equidistantly thereabout.

BRIEF DESCRIPTION OF THE DRAWINGS

The tamper-evident closure of the present invention can be further understood with reference to the drawings herein wherein.

DETAILED DESCRIPTION

Figure 1:
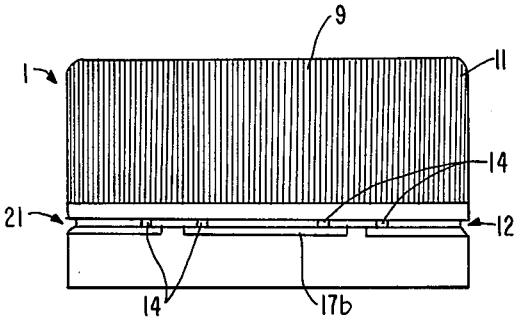
FIG. 1 is a side, elevational view of one embodiment of the closure used in connection with the tamper-evident container of the present invention.
Figure 4:
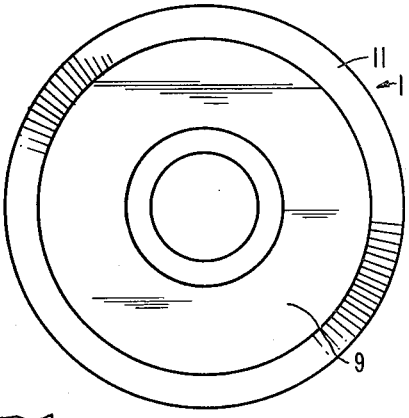
FIG. 4 is a top, elevational view of the closure of FIG. 1.

Referring to the figures, in which like numerals refer to like portions thereof, FIG. 1 shows a closure 1 for use in connection with the tamper-evident container of the present invention. Furthermore, in FIG. 5 the closure 1, which is preferably made with thermoplastic material, is completely threaded onto a bottle or container 3. In this case, the bottle itself includes a threaded neck portion 5 and an annular collar 7 therebelow. This annular collar 7 may in some cases be referred to as a transfer bead, since in the past it has been formed in connection with the manufacture of certain types of bottles (generally glass bottles) so as to assist in the transfer or movement of the bottle during its formation, or the bottle may include a separate transfer bead below the annular collar portion 7. It is, however, the collar 7 to which the closure of this invention will be firmly engaged or affixed, at least before fracture of the tamper-evident portion of the container.

Referring again to the closure 1, it includes an upper horizontal end wall 9, and internally threaded upper portion 11, which will correspond to the threaded neck portion 5 of the container 3 to which it is to be applied. The portion of the closure 1 which is below the collar or bead 7 when the closure is completely threaded onto or otherwise applied to the container 3 includes depending lower skirt portion 12. The inner surface of this depending lower skirt portion 12 includes an annular bead 16, which can best be seen in FIG. 6, and which includes an upper surface 18 and a lower surface 19. The lower surface 19 of bead 16 preferably has a gradual inclined or tapered surface, so that as the closure is being threaded or otherwise applied to the container and the surface 19 comes in contact with the upper surface of bead 7, the entire skirt portion 12 is gradually forced outwardly until it snaps over the bead 7, and the closure is thus completely applied to the container in the configuration shown in FIG. 5. On the other hand, the upper surface 18 of bead 16, which is at an angle with the horizontal which is less than that of the lower surface 19, and which can thus firmly engage the corresponding lower surface of collar 7, so as to prevent any such gradual outward motion of skirt portion 12, causing efficient fracture of the closure 1 as will be more fully discussed below.

Figure 2:
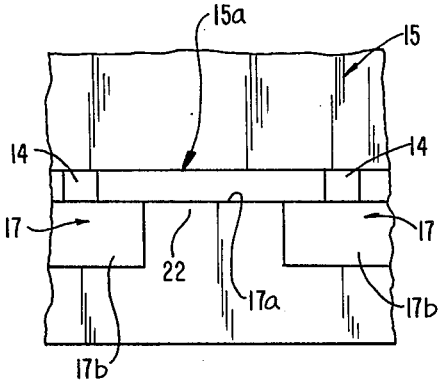
FIG. 2 is a side, elevational, enlarged view of a portion of the closure of FIG. 1.
Figure 3:
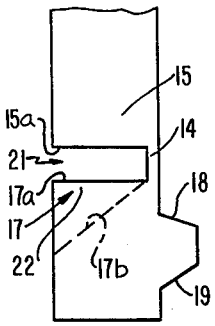
FIG. 3 is a side, cross-sectional, elevational view of the portion of the closure of FIG. 1 which is shown in FIG. 2.
Figure 6:
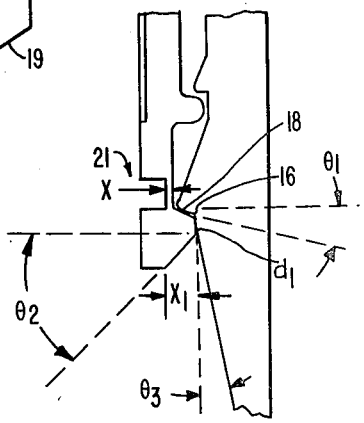
FIG. 6 is a partial, side, elevational, cross-sectional view of a portion of the tamper-evident container of FIG. 5.
Figure 5:
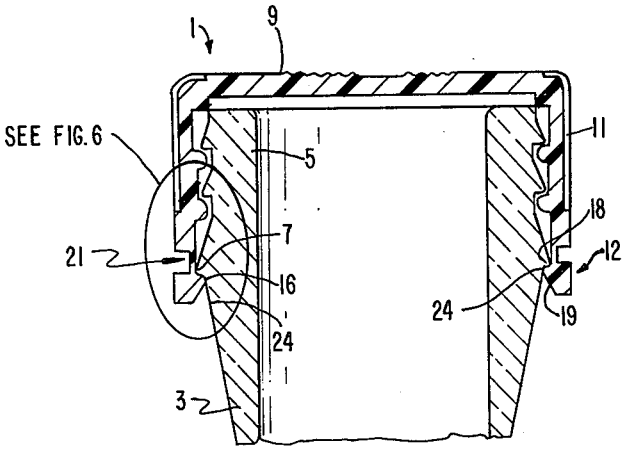
FIG. 5 is a side, elevational, cross-sectional view of a tamper-evident container of the present invention as applied.

As can be seen in FIGS. 1 through 5, an area of weakness is located in the intermediate side wall portion of the closure 1 above the annular bead portion 16 of the depending lower skirt portion 12, but below the internally threaded upper portion 11. In particular, a groove 21 is located on the outer surface of the closure 1. Groove 21 completely severs the intermediate side wall portions of the closure except for the remaining bridge portion(s) 14 which thus connects the upper and lower intermediate side wall portions formed by groove 21, designated as portions 15 and 17, as can best be seen in FIGS. 2 and 3. The bridges 14 preferably include a plurality of individual bridges located circumferentially around the closure, as is again shown in FIGS. 1 and 2. These bridges thus connect the upper and lower intermediate side wall portions 15 and 17, and preferably have a thickness represented by the distance X as shown in FIG. 6, representing the distance between the bottom of groove 21 and the inner wall of the closure, and generally being a distance from about 0.003 to 0.015 inches, preferably from about 0.006 to 0.010 inches and most preferably about 0.008 inches, e.g., from about 0.007 to 0.009 inches. These bridges 14 are thus sufficiently thin and flexible such that as the closure 1 is being applied to the container, and the lower surface 19 of the bead 16 comes into contact with the upper surface of the collar or bead portion 7 of the container, bridge portions 14 can collapse, and the upper and lower intermediate side wall portions 15 and 17 can come into direct abutment or contact with each other. In this manner the pressures created during application of the closures are applied between these abutting surfaces and are not substantially entirely placed upon the bridge portions 14 themselves. This, in turn, prevents premature fracture of the bridges 14 upon closure application. In other words, as the depending lower skirt portion 12, (i.e., the bead 16) of the closure 1 passes over the annular collar or bead portion 7 of the container, and flexes outwardly, this flexing motion is not transferred directly to the bridge portions 14, which have now collapsed, but is applied uniformly across the abutting upper and lower intermediate side wall surfaces 15 and 17. Additional means for dealing with these pressures in a more preferred manner are discussed below, but in any event this procedure, including collapse of the bridge portions 14, permits the depending lower skirt portion 12 to pass completely over the annular collar portion 7 of the container, as in the configuration shown for example in FIG. 5, without fracturing bridge portions 14, which thus retain their original configuration, i.e., as shown in FIG. 5, etc., with the upper and lower intermediate side wall portions now once again separated from each other and connected by bridge portions 14. In the particular embodiment shown in FIGS. 2 and 3, the surface of the lower intermediate side wall portion 17 is formed at an angle as shown at **17*b*. However, in such a case, it is far preferable to include in at least a portion of the lower intermediate side wall portion 17 stabilizer means 22. As can best be seen in FIGS. 2 and 3, stabilizer means 22, which preferably include a plurality of stabilizer means located circumferentially around the closure, thus provide the lower intermediate side wall portion 17 with portions having a horizontal surface 17*a* which is juxtaposed with and parallel to the surface 15*a* of the upper intermediate side wall portion 15, both of which are now in the horizontal plane of the closure 1. These surfaces 15*a* and 17*a* thus come into contact with each other when the bridge portions 14 have collapsed, and the major portion of the pressures created by application of the closure 1 to the container as the skirt portion 12 flexes over the bead 7 are applied through these surfaces and not through the bridge portions 14. In addition, however, the entire lower intermediate side wall portion 17 can also constitute a flat surface, i.e., one having the configuration of stabilizing means or tabs 22 (also discussed in more detail below) all the way around the circumference of the closure, in which case there will be no inclined portion 17*b* between separate tabs 22. Preferably, however, even when the entire upper intermediate side wall portion 15 is a flat surface as shown in FIGS. 2 and 3, there will be four tabs 22 located on the lower intermediate side wall portion, and preferably located at 90° intervals equidistantly around the circumference of the closure, so as to uniformly support the upper intermediate side wall surface upon collapse of the bridge members 14, as well as in order to facilitate the manufacturing process for the closure. Thus, these spaced tabs 22 will preferably be located between the spaced bridge members 14, preferably with two such spaced bridge members 14 between each of the spaced tabs 22. Again, such a configuration is quite helpful in reducing the pressures applied to the bridge members 14** and preventing any premature fracture thereof.

In a preferred embodiment, the stabilizing members 22 are in the form shown in FIGS. 7–10. That is, in this form the upper surface **17*a* of the stabilizing members 22 are located above the point where the bridge members 14 are attached to the lower intermediate side wall portion 17. That is, the distance between the lower face 15*a* of the upper intermediate side wall portion 15 and the upper surface 17*a* of the stabilizing members 22 will be less than the overall length of the bridge members 14. In this manner, while the stabilizing members 22 still perform their function of accepting the pressures created during closure application and during collapse of the bridge members 14, in this case that collapse is not complete, or is only partial, since surfaces 15*a* and 17*a* will engage each other before the bridge members 14 have collapsed entirely, thus preventing any further such collapse, and further lessening the stresses applied to bridge members 14 during closure application. In addition, these type of stabilizers 22 also prevent the bridge members 14** from entirely collapsing during the molding of these closures and in much the same manner.

Figure 7:
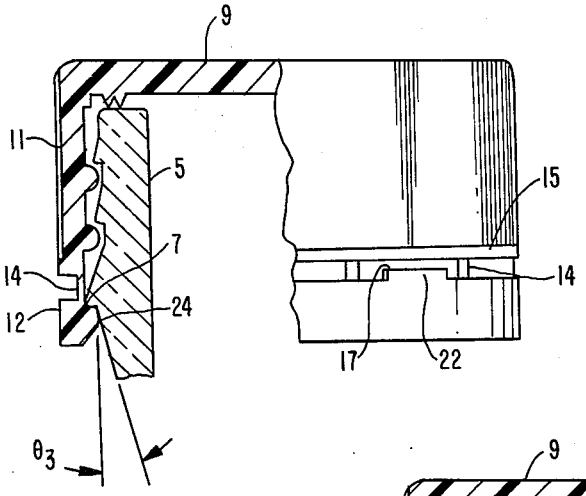
FIG. 7 is a side, elevational, partly cross-sectional view of a tamper-evident closure of the present invention prior to fracture.
Figure 8:
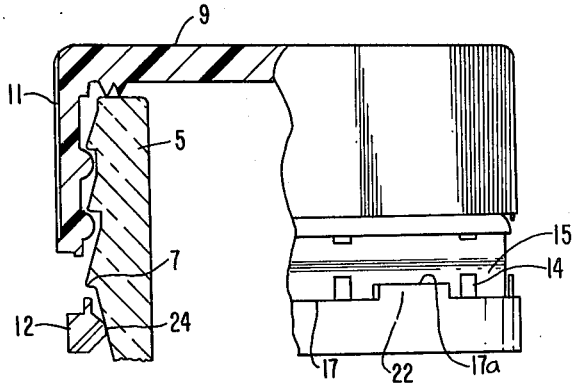
FIG. 8 is a side, elevational, partly cross-sectional view of a tamper-evident closure of the present invention subsequent to fracture.

Referring again to FIG. 1 and to FIGS. 7 and 8, groove 21 is formed in the outer wall of closure 1 in a manner such that when fracture occurs it occurs in a generally horizontal plane across the closure 1. Furthermore, fracture occurs at a location above the lower depending skirt portion 12 such that the entire lower depending skirt portion 12 then remains (after fracture) engaged to the container below the bead 7, i.e., after internally threaded upper portion 11 has been completely removed from the container. As can thus be seen, no part of the depending lower skirt portion 12 includes any weakened area therein.

Referring specifically to FIG. 6, the inwardly projecting bead 16 of the depending lower skirt portion 12 includes an upper surface 18 which is inclined at an angle $\theta_1$ with respect to the horizontal. This angle $\theta_1$ is generally between about 30 and less than about 60°, and preferably about 45°, thus providing a surface which is abrupt with respect to the horizontal, i.e., across the closure. On the other hand, the lower surface 19 of the inwardly projecting bead 16 is generally inclined at an angle $\theta_1$ with respect to the horizontal. This angle, $\theta_2$, is generally greater than about 60°, up about to 80°, and preferably about 75°, thus providing a far more gradually inclined surface with respect to the horizontal. In this manner, after the closure 1 has been applied to container 3, the upper surface 18 of the inwardly projecting bead 16 can firmly engage the bottle or container, again in the manner shown in FIG. 6. This, in turn, insures that upon unscrewing of the closure from the container 3, the bridges 14 will fracture, leaving behind the lower depending skirt 12. On the other hand, the far more gradual slope of the lower surface 19 of the inwardly projecting bead 16 permits that bead to easily move over the surface of the bead 7 on the container 3 during closure application, thereby protecting bridges 14 from premature fracture during such application.

In addition, the extent to which the inwardly projecting bead 16 projects inwardly from the inner surface of the outer cylindrical side wall of the closure, i.e., the distance $x_1$ as seen in FIG. 6, is a rather significant dimension in connection with this closure. Thus, this distance $x_1$ should be between about 0.020 and about 0.040 inches, and preferably about 0.030 inches. The distance $x_1$ is also significant in terms of its relationship to the diameter $d_1$ of the container at a point immediately below the bead 7 of container 3. That is, at the point below the bead portion 7 of the container 3 where the bead 16 contacts the surface of the container when the closure 1 is about to be removed from the container, the diameter of the container $d_1$ should be at least as great as the inner diameter of the bead 16, and preferably $d_1$ is greater than that dimension. Thus, at the very least there will be physical contact at this point, but preferably there will be an interference fit created between the inner diameter of the bead 16 and the wall of the closure at that point, i.e., by means of the flexibility of the plastic closure at that point pressing inwardly against the closure. It should be noted, however, that this discussion relates to the state of affairs as the closure 1 is being removed from the container. When the closure 1 is fully applied to the container, the bead 16 may well be disposed below that point of engagement where the container has a diameter $d_1$. As will be discussed in more detail below, this will actually separate the inner diameter of the bead 16 from the wall of the container, at least until the closure is about to be removed, at which time unthreading or the like will cause this contact to occur, and produce the desired interference fit therebetween. Indeed, this constitutes a preferred embodiment of this invention, since if the interference fit occurs when the closure is fully applied to the container, then such interference over a period of time could well cause a degree of stretching in the closure, and the desired degree of interference might be reduced or eliminated entirely.

In any event, this tight engagement of the bead 16 of the lower depending skirt portion 12 with the surface of the bottle below the head 7, which again will preferably occur upon closure removal, is significant from several respects. Firstly, such firm engagement facilitates removal of the closure 1 with simultaneous fracture of the bridge members 14. If, for example, the diameter $d_1$ were less than the inner diameter of the closure at the furthest inwardly projecting point on bead 16, and a space thus existed therebetween, it then would be possible, at least in some cases, for the closure to be completely removed, i.e., including the lower depending skirt portion 12, without fracturing. This could occur because, by shifting in the vertical plane, the bead 16 might then have sufficient play to move over the bead 7 of container 3 in an upward direction in at least one point around its circumference, and once this occurred the entire closure might be removed without fracturing all of the bridge members 14. If that were to happen, the entire purpose of this invention would be frustrated.

In accordance with the present invention the surface of the container below bead 7 tapers inwardly at 24 so as to produce a non-locking tapered surface therebelow. This non-locking tapered surface 24 projects downwardly at an angle $\theta_3$ of greater than about 8°, preferably between about 10° and 20°, and most preferably between about 14° and 16°, such as at about 15°. It is in this manner that the drop-down feature of the present invention can now be realized, and in a manner which insures that subsequent to fracture of the bridge members 14 the lower depending skirt portion 12 will drop-down, as is shown particularly in connection with FIG. 8, and in order to visibly demonstrate that the closure has been removed, i.e., tamper-evidence is provided.

For purposes of comparison, if the surface of the bottle or container 3 below bead portion 7 were to be substantially vertical, and in particular in a situation where, as with the present closure, there were substantial contact between the inner portion of bead 16 with the surface of the container 3 below the bead 7, fracture of the bridges 14 would then leave the lower depending skirt portion 12 firmly engaged with the bottle at that point, i.e., immediately below the bead 7. The firmer this engagement, the more likely it would be that this would occur, and the less likely it would be that there would be any drop-down of the now-fractured depending skirt portion 12. Thus, as the desirable feature of firmness in the engagement between the bead 16 and the surface of the bottle 3 at that point were increased, the likelihood of any drop-down would be decreased. In accordance with the present invention, however, the very opposite is the case, i.e., as the firmness of this engagement therebetween is increased, the likelihood of drop-down substantially increases. In view of the existence of the non-locking tapered surface 24 subsequent to fracture the application of pressure between the bead 16 and the surface of the container 3 now causes the lower depending skirt portion 12 to ride downwardly along the non-locking tapered surface 24 into the position shown in FIG. 8.

As has been the case in the past, and where the surface of the container immediately below the bead 7 is substantially vertical, and the lower depending skirt portion 12 thus remains affixed thereto at that point, it is thus possible for the remaining upper portion 11 of the closure 1 to be fully reapplied to the container, in which case even though the bridge members 14 have fractured this is not immediately clearly visible, at least not without careful inspection. It thus remains possible for an observer to fail to recognize that fracture has occurred, thus again entirely defeating the principal purposes for using these closures in the first place. However, in accordance with the features of the present invention, when drop-down has occurred into a configuration such as that shown in FIG. 8, this is no longer possible, and the observer can immediately see that the depending lower skirt portion 12 has been separated from the upper portion of the closure 1, i.e., that fracture has occurred.

Figure 9:
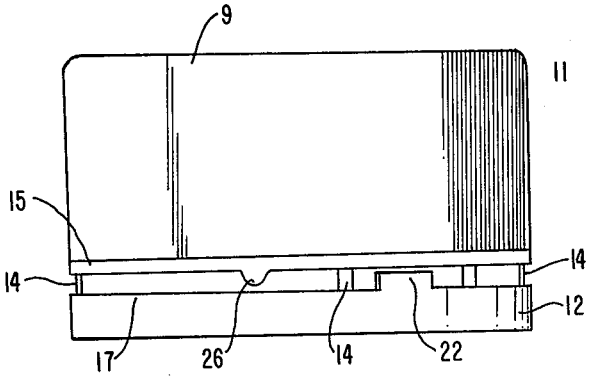
FIG. 9 is a side, elevational, view of another closure used in connection with the tamper-evident container of the present invention.
Figure 10:
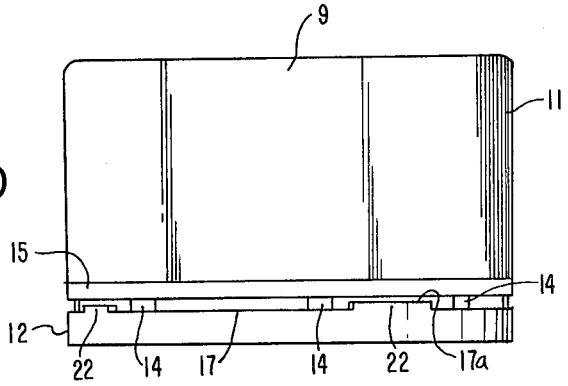
FIG. 10 is a side, elevational view of another embodiment of a closure used in connection with the tamper-evident container of the present invention.

Referring next to FIG. 9, one or more additional cams 26 can also be included on the upper intermediate side wall portion 15. Thus, in conjunction with the presence of tabs 22 on the lower intermediate side wall portion 17, assurance is provided that the drop-down feature shall occur. In other words, subsequent to fracture and removal, if the upper portion 11 of the closure 1 is reapplied or threaded onto the container 3, and should the lower depending skirt portion 12 still remain below the bead 7 of the container 3 for any reason, then upon such threading, cam 26 will come into contact with the upper surface 17*a* of tab 22, thus driving the depending lower skirt portion 12 downwardly.

Referring once again to FIG. 1, the outer surface of the internally threaded upper portion 11 can also include an area containing a plurality of vertical serrations 25 forming a roughened surface thereon. This surface has been found to be not only aesthetically appealing, but it also aides one in gripping the closure in order to twist it and thus fracture the bridges 14 and remove the internally threaded upper portion 11 therefrom.

As noted above, the closure 1 of the present invention is preferably made of a thermoplastic material, and can be manufactured in an injection molding process. Thus, the internal threads of the closure 1 can be formed by the action of an unscrewing mold. That is, after the part has been formed, during opening of the mold, the cores of the mold rotate and unscrew from the closure, thus forming the threads. The closure itself is kept from turning during this unscrewing phase by means of steel teeth, which engage in the bottom of the closure and hold it in place as the core rotates.

After the unscrewing cycle is completed, a stripper plate, which is part of the mold itself, ejects the finished closure from the mold. As the mold initially opens, and before the unscrewing cycle occurs, the closure is released from an undercut position in the mold by means of angle pins which cause cam bars to separate from around the closure. This undercut position was created because protruding portions of the mold (cams) were required in order to mold the annular groove, i.e., the weak portion of the closure which is intended to fracture.

The relationship between the internal diameter of this protruding groove in the cams to the outside diameter of the mold core determines the dimension "x" shown in FIG. 6 at the deepest part of the groove, i.e., the thickness of the bridge portions 14. It is also thus possible to change that dimension in the closure by merely replacing these cam sections.

The closure can also be manufactured without using this unscrewing procedure by the stripper plate pushing the closure from the stationary core, in a process known as the stripping process.

Further, as an alternate to the cam action, the outside groove can be machined into a solid section of the closure as a secondary operation to the initial molding step. The remainder of the molding process is the same as in conventional thermoplastic molding processes.

The closure of the present invention can also be adapted to be used with a variety of containers and bottles, i.e., where for example the annular collar or bead of the bottle has different dimensions from those shown in FIG. 6, or is located at different positions relative to the end of the neck 5 of the bottle or container. These various embodiments are discussed in applicant's prior patent applications, and in issued U.S. Pat. No. 4,343,408, and those portions thereof are incorporated herein by reference thereto.

These various embodiments include various sealing means therein, such as a yieldable sealing disc which can be made of cork or other such commercial lining materials, and other such sealing means, all of which are also shown in issued U.S. Pat. No. 4,343,408, and are also incorporated therein by reference thereto.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. A tamper-evident container comprising a container including a neck portion and an annular collar portion below said neck portion, and a closure for application to said container, said closure comprising a one piece closure body including a horizontal end wall and cylindrical side wall, said cylindrical side wall including an upper portion, a depending lower skirt portion, and an intermediate side wall portion therebetween, said depending lower skirt portion including an inwardly projecting bead having an internal diameter no greater than the outer diameter of said container at a predetermined location directly below said annular collar portion so as to provide an interference fit between said inwardly projecting bead and said container at said predetermined location, said intermediate side wall portion of said closure including a frangible portion comprising an area of weakness designed to fracture when said closure is removed from said container so as to leave said depending lower skirt portion on said container after said upper portion has been removed from said container, said container including an inwardly directed non-locking tapered surface at said predetermined location whereby after said fracture of said closure at said area of weakness said depending lower skirt portion is caused to move downwardly along said non-locking tapered surface, away from said annular collar portion, to thereby provide visual evidence of said fracture.

2. The tamper-evident container of claim 1 wherein the internal diameter of said inwardly projecting bead is less than the outer diameter of said container at said predetermined location.

3. The tamper-evident container of claim 1 wherein said frangible portion divides said intermediate side wall portion into an upper intermediate side wall portion and a lower intermediate side wall portion above and below said frangible portion, respectively, said frangible portion comprising bridge means located circumferentially around said closure, said bridge means being sufficiently thin and flexible so as to be capable of collapsing when said inwardly projecting bead passes over said annular collar portion of said container as said closure is being applied to said container to thereby permit said upper and lower intermediate side wall portions to abut against each other and thereby permit said closure to be applied to said container without fracturing said bridge means.

4. The tamper-evident container of claim 1 wherein said neck portion of said container comprises a threaded neck portion, and said upper portion of said cylindrical side wall of said closure comprises an internally threaded upper portion.

5. The tamper-evident container of claim 1 wherein said upper and lower intermediate side wall portions are in substantial alignment with each other in the plane of said cylindrical side wall.

6. The tamper-evident container of claim 1 wherein said non-locking tapered surface comprises an angle of more than about 8°.

7. The tamper-evident container of claim 1 wherein said non-locking tapered surface comprises an angle of between about 10° and 20°.

8. The tamper-evident container of claim 1 wherein at least a portion of said upper and lower intermediate side wall portions include juxtaposed parallel surfaces for providing surfaces for abutment of said upper and lower intermediate side wall portions upon the collapse of said bridge means.

9. The tamper-evident container of claim 8 wherein said lower intermediate sidewall portion includes a plurality of stabilizer members.

10. The tamper-evident container of claim 9 wherein said upper intermediate side wall portion includes protruding cam means for engagement with said plurality of stabilizer members on said lower intermediate side wall portion so as to insure that said depending lower skirt portion is caused to move downwardly thereby when said closure is reapplied to said container.

11. The tamper-evident container of claim 10 wherein said upper intermediate side wall portion includes a plurality of said cam means.

12. The tamper-evident container of claim 1 wherein said bridge means comprises a plurality of bridge means located circumferentially around said closure.

13. The tamper-evident container of claim 12 including eight of said bridge members located equidistantly about said closure.

14. The tamper-evident container of claim 1 wherein said inwardly projecting bead includes an inclined lower surface defining a plane disposed at a first angle with respect to the horizontal, for assisting in the gradual outward bending of said depending skirt portion as it passes over said annular collar portion of said container upon said application of said closure onto said container without fracturing said frangible portion, and an inclined upper portion defining a plane disposed at a second angle with respect to the horizontal for engagement with said annular collar portion of said container when said closure is completely applied to said container, said second angle being greater than said first angle, whereby said depending lower skirt portion cannot gradually bend outward when said closure is removed from said container without causing said fracture to occur.

15. The tamper-evident container of claim 1 wherein said bridge members have a thickness of between about 0.003 and 0.015 inches.

* * * * *